United States Patent [19]

Jartoux

[11] Patent Number: 4,941,303

[45] Date of Patent: Jul. 17, 1990

[54] ANCHORING DEVICES FOR TENSILE BRACES

[75] Inventor: Pierre Jartoux, Epernon, France

[73] Assignee: Freyssinet International (STUP), Coignieres, France

[21] Appl. No.: 270,432

[22] Filed: Nov. 8, 1988

Related U.S. Application Data

[63] Continuation of Ser. No. 76,403, Jul. 22, 1987, abandoned.

[30] Foreign Application Priority Data

Jul. 31, 1986 [FR] France ..... 86 11140

[51] Int. Cl.[5] ..... E04C 3/10

[52] U.S. Cl. ..... 52/223 L; 52/230

[58] Field of Search ..... 52/223 L, 230

[56] References Cited

U.S. PATENT DOCUMENTS

| | | | |
|---|---|---|---|
| 2,180,866 | 11/1939 | Cryer | 52/223 L |
| 2,294,398 | 9/1942 | Ferguson | 52/223 L |
| 3,163,904 | 1/1965 | Ziolkowski | 24/126 |
| 3,673,644 | 7/1972 | Howlett | 52/223 L |
| 3,703,748 | 11/1972 | Kelly | 52/223 L |
| 3,965,541 | 6/1976 | Davison | 52/230 |
| 4,144,686 | 3/1979 | Gold | 52/223 L |
| 4,640,068 | 2/1987 | Jungwirth | 52/223 L |

FOREIGN PATENT DOCUMENTS

| | | | |
|---|---|---|---|
| 544574 | 2/1956 | Belgium | 52/223 L |
| 1250101 | 9/1967 | Fed. Rep. of Germany | 52/230 |
| 2550137 | 12/1977 | Fed. Rep. of Germany . | |
| 1237901 | 6/1960 | France | 52/223 L |
| 2069424 | 9/1971 | France . | |
| 2516573 | 5/1983 | France . | |
| 2524030 | 9/1983 | France | 52/230 |
| 880224 | 10/1961 | United Kingdom | 52/223 L |
| 895519 | 5/1962 | United Kingdom . | |

*Primary Examiner*—Henry E. Raduazo

*Attorney, Agent, or Firm*—Fleit, Jacobson, Cohn, Price, Holman & Stern

[57] ABSTRACT

An anchoring device for a tensioned cable comprises a split jaw with a striated inner cylindrical surface and with an outer lateral surface of frustoconic shape, which surrounds one end of the cable and cooperates with a complementary housing hollowed in a rigid part. This housing is so dimensioned so that it surrounds continuously the whole of the tapered end of the jaw. The half-angle at the apex of the outer lateral surface, of frustoconic shape, of the tapered end of the jaw is less than 10°. The radial thickness of the annular terminal section of said tapered end is less than or equal to to 1/10 of the inner radius of said end.

11 Claims, 1 Drawing Sheet

ANCHORING DEVICES FOR TENSILE BRACES

This application is a continuation, of application Ser. No. 076,403, filed July 22, 1987 now abandoned.

BACKGROUND OF THE INVENTION

The invention relates to anchoring devices for tensile braces and more particularly those, among these devices, which comprise a longitudinally split annular jaw having a rough inner cylindrical surface, particularly striated, and an outer lateral surface of frustoconic shape, which jaw surrounds one end of the brace to be anchored and which cooperates with a complementary housing hollowed in a rigid anchoring part, this housing being dimensioned so that it surrounds contiguously the whole of the tapered end of the jaw.

It relates more particularly to the case where the brace to be anchored is subject to periodic variations in tension and hence in extension, as is the case for the guy cables which support the decks of suspension bridges.

In the following, the braces concerned will be denoted by the word cables for the purpose of simplification and purely by way of illustration, the braces concerned being generally constituted by cables or strands composed of several twisted wires, but which can also be constituted differently, for example by rods.

In the present embodiments of anchoring devices of the above type, the jaw is practically undeformable and the variations in extension of the cable are manifested by relative movements between the rough inner face of the thinnest end of the jaw and the section of cable surrounded by this end.

These relative movements are sources of wear of said section.

This wear has the effect of tearing from said section very small particles of metal (generally of iron) which are rapidly oxidized and swell for this reason; by migrating then into the grain boundaries of the constituent metal structure of the section of cable, these swollen oxide particles exert a jamming effect which can burst this structure and hence create fissures in the cable, or even break the latter.

It is a particular object of the invention to overcome this drawback.

GENERAL DESCRIPTION OF THE INVENTION

Accordingly, split frustoconic jaws according to the invention are selected from among those for which the half-angle at the apex of the outer lateral surface, of frustoconic shape, of the tapered end is less than 10° and they are characterized in that the radial thickness E of the annular terminal section of said tapered end is less than or equal to 1/10 of the inner radius R of this end.

In preferred embodiments, recourse is had in addition to one and/or other of the following features:

- the half angle at the apex of the outer lateral surface, of frustoconic shape, of the tapered end of the jaw is of the order of 5° to 6°,
- the half-angle at the apex according to the preceeding paragraph decreases and tends towards zero in the direction of the terminal section of the tapered end,
- the length of the jaw is greater than 30 times the above radial thickness E,
- the portion of the inner surface, of the housing receiving the jaw, which surrounds the tapered end of this jaw and is applied contiguously against this end, is polished,

- a lubricant is interposed between the tapered end of the jaw and the facing surface of the housing with which said end cooperates.

The invention comprises apart from these main features, certain other features which are preferably used at the same time and which will be more explicitly considered below.

DESCRIPTION OF PREFERRED EMBODIMENTS

In the following, a preferred embodiment of the invention will be described with reference to the accompanying drawing given of course in purely non-limiting illustration.

Figure 1:
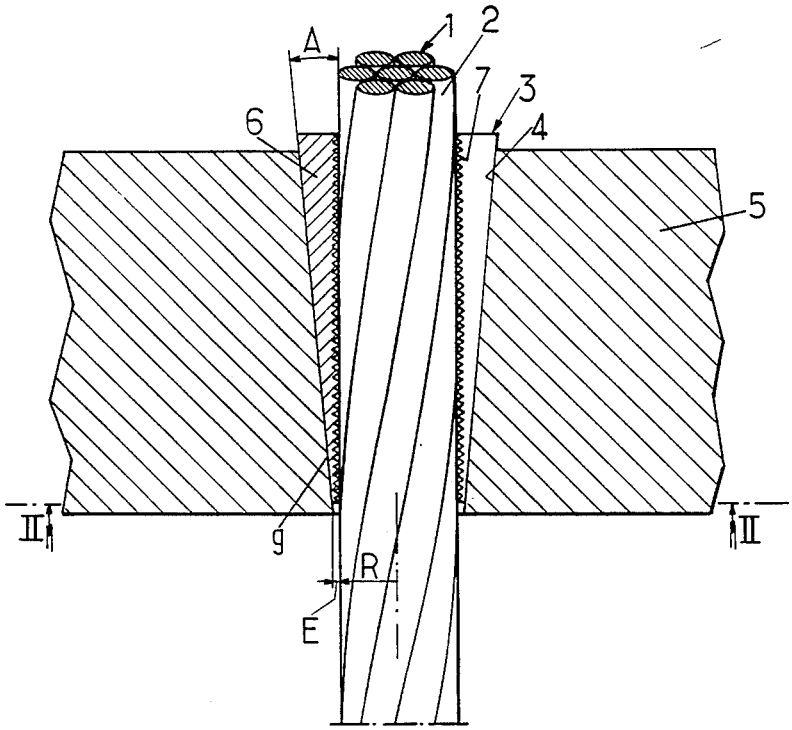
Figure 2:
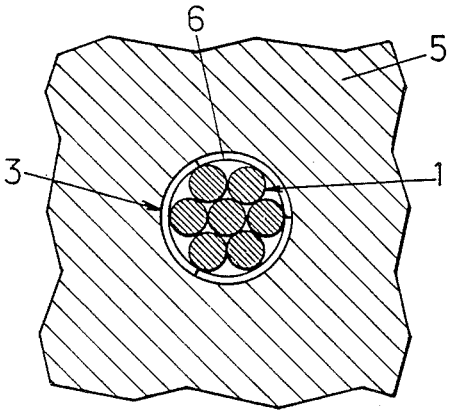

FIGS. 1 and 2 of this drawing show respectively in axial section and in cross-section along the line II—II, FIG. 1, a cable anchoring device constructed according to the invention.

In manner known in itself, the cable 1 is here composed of twisted steel wires 2 and the anchoring device comprises a split jaw 3 of frustoconic shape adapted to surround this cable contiguously and introduced into a complementary housing 4 itself hollowed in a rigid anchoring plate 5.

The split jaw is composed of three identical keys 6 forming through their lateral juxtaposition, a ring whose inner surface is a cylinder of revolution and whose outer surface has a frustoconic shape of revolution.

The inner cylindrical surface of the jaw is made rough by the formation of striae of ridges 7 or by gluing abrasive grains.

If the tapered end of the jaw is relatively thick, namely of the order of 2 mm or more as in known embodiments, this end is not deformable.

If then the cable is subjected to variable tensions, that is to say to alternative longitudinal deformations, as is the case, for example, for the braces supporting the decks of suspension bridges, experience shows that there is a risk of fissure or even of breaking of the cable at the level of the tapered end of the jaw.

In fact, if the amplitude of the longitudinal deformations of the cable is nil at the level of the large base of the jaw, where the anchorage in the rigid part 5 is fully ensured, it is on the contrary a maximum at the level of the small base of the jaw, considering that beyond this small base the freedom of deformation of the cable is not hampered in any way.

When the keys are not deformable even at their tapered ends, there are bound to be observed at the level at the small base of the jaw, slidings with friction between the cable and the keys, which can tear metal molecules from the cable, which are oxidized, swell and risk causing the surrounding metal structure to burst through penetrating into the grain boundaries of the metal structure of the cable through an effect comparable with that of wooden wedges swollen with water.

To overcome this drawback, according to the invention, the tapered end of the jaw is made extremely thin whilst making this end intimately fast with the cable.

The result of this double feature is that on the one hand the tapered end concerned is longitudinally deformable and that, on the other hand, it is in fact deformed longitudinally when the cable is.

The slidings generating friction and wear which were previously observed between the cable 1 and the key 6 hence no longer occur and are replaced by slidings between the key 6 and their housing 4.

Now at the housing-key interface, denoted by the reference g in FIG. 1, the slidings can take place without damage, the surfaces in contact being then both smooth and no inconvenience resulting from their relative movements.

To reduce the risk of friction at this interface g to the maximum, it may be advantageous:

to polish the inner surface of the housing 4, or at least its portion which surrounds the tapered end of the jaw, and even to insert a lubricant between said surface or end and the jaw which coacts with it.

The extreme thinness of the tapered end of the jaw is defined as follows.

On the one hand the thickness E of the annular terminal section of this end is at most equal to 1/10 of the internal radius R of this section.

By way of example, if the radius R is of the order of 8 mm, the thickness E is comprised between 0.5 and 0.8 mm.

On the other hand the half angle at the apex A of the lateral surface of revolution of frustoconic shape which bounds the tapered end of the jaw externally is less than 10°.

This half-angle A is preferably of the order of 5.5°.

As for the intimate radial application of each tapered end of a key against the cable, it is ensured by a tight imprisonment of this end between the housing 4 of the jaw and said cable 1.

In other words, said end does not project axially from the anchoring plate 5: its terminal section is on the contrary within this plate.

To increase further this double effect of thinness and of radial gripping of the tapered end of the jaw against the cable, modifications can be envisaged according to which the half-angle of the apex A of the outer lateral surface of this tapered end would be almost nil, this surface no longer having then a strictly frustoconic shape but a shape of revolution approaching a cylinder and whose generator would extend along an arc of a hyperbola allowing an asymptote parallel with the axis of the jaw.

In preferred embodiments, the keys 6 are not only very thin, but also relatively long: their length L is generally greater than 30 times the thickness E of the terminal section of their tapered end as defined above.

By way of purely illustrative example, it is indicated that, in an embodiment which has given entire satisfaction, the jaw was composed of three identical keys for which the dimensions E, R, and L above were respectively 0.7 mm, 8 mm, and 45 mm.

The outer diameter of the largest base of the jaw was 27 mm and the ridges 7 had a pitch of 0.5 mm and depth of 0.3 mm.

As a result of which, and whatever the embodiment adopted, there are finally obtained anchoring devices for cables whose constitution result sufficiently from the foregoing.

These devices have, over those previously known, the important advantage of considerably increasing the life span or resistance to "fatigue" of the cables anchored by them when the latter are subject to dynamic effects, that is to say variable effects, due to the fact that the relative movement between each cable and the corresponding anchoring part is transferred from the rough cable-tapered end interface of the keys to the tapered end smooth interface of the key-housing of these ends, which transfer is made possible by the extreme thinness given to said tapered ends, combined with the close gripping of the latter against the cable and the rough state of the inner surface of said ends, which are hence made intimately fast with the cable portion they surround.

As is the self-evident, and as results besides already from foregoing, the invention is no way limited to those of its types of application and embodiments which have been more especially envisaged; it encompasses, on the contrary, all modifications, particularly those where the number of slits provided in each jaw, this number determining that of the constituent keys of the jaw, would be different from three and, for example, equal to one, two or four.

I claim:

1. A longitudinally split jaw for use in an anchoring device for a tensioned cable, which anchoring device has a housing with a frustoconic shaped passage formed therein, said jaw having a rough inner cylindrical surface along the entire length thereof and having an outer lateral surface of frustoconic shape such that said jaw has a tapered end and a half-angle at an apex of the outer lateral surface of the tapered end which is less than 10° and a radial thickness of an annular terminal section of said tapered end which is less than or equal to 1/10 of an inner radius of said tapered end; wherein when said jaw is positioned within the frustoconic shaped passage in the housing, the housing contiguously surrounds the totality of the tapered end of the jaw.

2. Jaw according to claim 1, wherein the half-angle at the apex of the outer lateral surface of its tapered end decreases and tends towards zero in the direction of the terminal section of said end.

3. Jaw according to claim 1 wherein its length is greater than 30 times the thickness of the terminal section of its tapered end.

4. Anchoring device for a tensioned cable, comprising:

a longitudinally split jaw adapted to surround one end of a cable, said jaw having a rough inner cylindrical surface along the entire length thereof which defines an inner radius of a value such that the rough inner cylindrical surface grips the cable fast in intimate contact therewith when the jaw is assembled to the cable, said jaw also having an outer lateral surface of frustoconic shape such that said jaw has a tapered end which is longitudinally deformable with the cable when the cable is gripped fast by the jaw the jaw further having a half-angle at an apex of the outer lateral surface of the tapered end which is less than 10° and a radial thickness of an annular terminal section of the tapered end of the jaw which is less than or equal to 1/10 of the inner radius of the tapered end, the half-angle at the apex of the outer lateral surface of the tapered end of the jaw, as measured between the outer lateral surface and the rough inner cylindrical surface at the tapered end of the jaw, being less than or equal to a correspondingly measured half-angle at the opposite end of the jaw both prior to and after assembly of the jaw to the cable; and a complementary housing which cooperates with said jaw, said jaw being received in a frustoconic shaped passage formed in a rigid part of said housing, said passage being dimensioned such that said housing contiguously surrounds and applies radial pressure to the totality of the tapered end of the jaw which is greater than or at least equal to the pressure applied by the housing to the opposite end of the jaw, and so that any of said longitudinal deformation of the tapered end with the cable occurs without any relative longitudinal sliding movement between the jaw and the cable.

5. Anchoring device according to claim 4, wherein the half-angle at the apex of the outer lateral surface of frustoconic shape, of the tapered end of the jaw is of the order of 5°.

6. Anchoring device according to claim 4, wherein the half-angle at the apex of the outer lateral surface of the tapered end of the jaw decreases and tends towards zero in the direction of the terminal section of this end.

7. Anchoring device according to claim 4, wherein the length of the jaw is greater than 30 times the thickness of the terminal section of its tapered end.

8. Anchoring device according to claim 4, wherein the portion of the inner surface of the housing receiving the jaw which surrounds the tapered end of this jaw and is applied contiguously against this end, is polished.

9. Anchoring device according to claim 8, wherein a lubricant is interposed between the tapered end of the jaw and the opposite surface of the housing with which said end cooperates.

10. Anchoring device according to claim 4, wherein the inner radius of the terminal section of the tapered end of the jaw is of the order of 8 mm and wherein the thickness of this section is of the order of 0.6 to 0.8 mm.

11. Anchoring device for a tensioned cable, comprising:

a longitudinally split jaw adapted to surround one end of a cable, said jaw having a rough inner cylindrical surface along the entire length thereof which defines an inner radius of a value such that the rough inner cylindrical surface grips the cable fast in intimate contact therewith when the jaw is assembled to the cable, said jaw also having an outer lateral surface of frustoconic shape with a single taper along the entire length thereof such that said jaw has a tapered end which is longitudinally deformable with the cable when the cable is gripped fast by the jaw, the jaw further having a half-angle at an apex of the outer lateral surface of the tapered end which is less than 10° and a radial thickness of an annular terminal section of the tapered end of the jaw which is less than or equal to 1/10 of the inner radius of the tapered end, the half-angle at the apex of the outer lateral surface of the tapered end of the jaw, as measured between the outer lateral surface and the rough inner cylindrical surface at the tapered end of the jaw, being less than or equal to a correspondingly measured half-angle at the opposite end of the jaw both prior to and after assembly of the jaw to the cable; and a complementary housing which cooperates with said jaw, said jaw being received in a frustoconic shaped passage formed in a rigid part of said housing, said passage being dimensioned such that said housing contiguously surrounds and applies radial pressure to the totality of the tapered end of the jaw which is greater than or at least equal to the pressure applied by the housing to the opposite end of the jaw, and so that any of said longitudinal deformation of the tapered end with the cable occurs without any relative longitudinal sliding movement between the jaw and the cable.

* * * * *